US011373819B2

(12) United States Patent
Chiu

(10) Patent No.: US 11,373,819 B2
(45) Date of Patent: Jun. 28, 2022

(54) KEY STRUCTURE AND KEYCAP ASSEMBLY THEREOF

(71) Applicant: CHICONY ELECTRONICS CO., LTD., New Taipei (TW)

(72) Inventor: Ta-Wen Chiu, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/325,272

(22) Filed: May 20, 2021

(65) Prior Publication Data

US 2022/0115193 A1 Apr. 14, 2022

(30) Foreign Application Priority Data

Oct. 14, 2020 (TW) ..... 109135554

(51) Int. Cl.
*H01H 13/14* (2006.01)
*H01H 13/705* (2006.01)

(52) U.S. Cl.
CPC ..... *H01H 13/14* (2013.01); *H01H 13/705* (2013.01); *H01H 2233/07* (2013.01)

(58) Field of Classification Search
CPC .. H01H 13/14; H01H 13/705; H01H 2233/07; H01H 13/7065; H01H 13/20; H01H 13/7057; H01H 13/70; H01H 3/12
USPC ..... 200/344, 345
See application file for complete search history.

(56) References Cited

U.S. PATENT DOCUMENTS 5,145,058 A * 9/1992 Lee ..... H01H 13/705 200/290
5,203,448 A * 4/1993 Osada ..... H01H 13/705 200/517
5,209,588 A * 5/1993 Chen ..... B41J 5/12 400/472
6,184,481 B1 * 2/2001 Chen ..... G06F 3/0202 200/341

* cited by examiner

*Primary Examiner* — Lheiren Mae A Caroc
(74) *Attorney, Agent, or Firm* — Muncy, Geissler, Olds & Lowe, P C.

(57) ABSTRACT

A key structure includes a casing, a restoring member and a keycap assembly. The casing has an opening. The restoring member is disposed in the casing. The keycap assembly includes a keycap and a holder. The keycap includes a pressing portion and a central shaft. The pressing portion has a bottom surface. The central shaft connects to the bottom surface. The central shaft has a hemispherical portion adjacent to the bottom surface. The holder is inserted into the casing via the opening and contacts the restoring member. The holder includes a shaft bore. The shaft bore has an arcuate socket. The central shaft passes through the shaft bore and contacts the restoring member, and the hemispherical portion is accommodated in the arcuate socket.

20 Claims, 7 Drawing Sheets

KEY STRUCTURE AND KEYCAP ASSEMBLY THEREOF

BACKGROUND

1. Technical Field

The present invention relates to a key structure.

2. Description of the Related Art

A keyboard is commonly used in conjunction with a computer as one of the essential input devices. Generally, most computers and peripheral devices used with computers are progressively developed to be lighter, thinner, and more compact in design. Keyboards have also been reduced in volume over time. Earlier keyboards were relatively large, while slim keyboards are very common today. The slim keyboard usually uses a membrane circuit board and is also known as a membrane keyboard. The main structure of the membrane keyboard includes a membrane circuit board, a plurality of restoring members (referred to as elastic members) and a plurality of keycaps. The switch of the membrane circuit board is triggered by pressing the keycap, and the restoring member provides a force for returning the keycap to its original position.

A common mechanism for assisting the keycap to move up and down comprises a crater structure and a scissor type structure. In terms of the crater structure, a plurality of raised openings is formed on a casing of the keyboard for assembling the keycaps. Correspondingly, each keycap has at least one guiding post and at least one snap. The guiding post moves along an inner wall of the opening and guides the snap into the casing (opening), and then the snap is engaged with a bottom edge of the opening to accomplish the assembly of the keycap. When the keycap moves up and down, the limiting effect between the guiding post and the inner wall of the opening causes the keycap to move vertically, without oblique motion.

However, when a corner of the keycap (i.e., one of the four corners of the keycap) is pressed, the movable space of the keycap and the guiding post thereof is limited due to the limiting effect between the guiding post and the inner wall of the opening, so the keycap may more easily become stuck. As a result, the user must exert more force to press the keycap down. Therefore the prior art still has room for improvement.

SUMMARY

In view of the above issues, it is an objective of the present invention to provide a key structure and a keycap assembly thereof to resolve the issue of the keycap of the conventional key structure with the crater structure easily becoming stuck by providing a keycap assembly having a keycap and a holder, and a novel structure of the keycap and the holder.

In order to achieve the above objectives, the present invention provides a key structure, which comprises a casing, a restoring member and a keycap assembly. The casing has an opening. The restoring member is disposed in the casing. The keycap assembly comprises a keycap and a holder. The keycap comprises a pressing portion and a central shaft. The pressing portion has a bottom surface. The central shaft is connected to the bottom surface. The central shaft has a hemispherical portion adjacent to the bottom surface. The holder is inserted into the casing via the opening and contacts the restoring member. The holder comprises a shaft bore having an arcuate socket. The central shaft passes through the shaft bore and contacts the restoring member, and the hemispherical portion is accommodated in the arcuate socket.

In order to achieve the above objectives, the present invention further provides a keycap assembly, which is used in a key structure. The key structure comprises a casing and a restoring member. The casing has an opening. The restoring member is disposed in the casing. The keycap assembly comprises a keycap and a holder. The keycap comprises a pressing portion and a central shaft. The pressing portion has a bottom surface. The central shaft is connected to the bottom surface. The central shaft has a hemispherical portion adjacent to the bottom surface. The holder is inserted into the casing via the opening and contacts the restoring member. The holder comprises a shaft bore having an arcuate socket. The central shaft passes through the shaft bore and contacts the restoring member, and the hemispherical portion is accommodated in the arcuate socket.

In an embodiment of the present invention, when the pressing portion is pressed, the hemispherical portion is displaced in the arcuate socket.

In a embodiment of the present invention, when an edge of the pressing portion is pressed, a contact point between the hemispherical portion and the arcuate socket forms a point of resisting force.

In an embodiment of the present invention, the central shaft further comprises a shaft portion, and the shaft portion extends from the hemispherical portion in a direction away from the bottom surface.

In an embodiment of the present invention, both the shaft portion and the shaft bore are non-circular in structure.

In an embodiment of the present invention, the shaft portion has a first plane, the shaft bore of the holder has a second plane, and the first plane corresponds to the second plane to restrict the shaft portion from rotating in the shaft bore.

In an embodiment of the present invention, the holder further comprises a guiding post contacting an inner wall of the opening, and a top surface of the guiding post does not contact the pressing portion.

In an embodiment of the present invention, the guiding post corresponds to one corner of the opening, and the holder is guided into the casing by the guiding post.

In an embodiment of the present invention, the guiding post has a curved side surface, and the curved side surface is in linear contact with the opening.

In an embodiment of the preset invention, the top surface of the guiding post is an oblique plane extending outward and toward the casing.

In an embodiment of the present invention, the keycap comprises at least one first snap connecting to the bottom surface, and the first snap is inserted into the casing via the opening and snaps onto the casing.

In an embodiment of the present invention, the holder further comprises a second snap, and the second snap is inserted into the casing via the opening and snaps onto the casing.

As mentioned above, according to a key structure and a keycap assembly of the present invention, the keycap assembly comprises a keycap and a holder. A central shaft of the keycap has a hemispherical portion, and a shaft bore of the holder has an arcuate socket corresponding to the hemispherical portion. After the central shaft passes through the shaft bore, the hemispherical portion is accommodated in the arcuate socket. Because of the matched structure of the hemispherical portion and the arcuate socket, the hemispherical portion can be displaced in the arcuate socket to increase the movable space of the keycap. In brief, because the keycap assembly is a two-piece structure (i.e., comprising the keycap and the holder) and the hemispherical portion and the arcuate socket are matched with each other, the space for displacement of the keycap can be increased such that the keycap can be prevented from becoming stuck.

In addition, the holder has a guiding post, and the design is such that the guiding post does not contact the pressing portion of the keycap, which ensures that the pressing portion has space for shifting or tilting without being restricted by the guiding post, so as to achieve the aforementioned effect of preventing the keycap from becoming stuck.

BRIEF DESCRIPTION OF THE DRAWINGS

In the drawings, wherein similar reference numerals denote similar elements throughout the several views.

DETAILED DESCRIPTION OF THE EMBODIMENTS

In order to make the structure and characteristics as well as the effectiveness of the present invention to be further understood and recognized, detailed description of the present invention is provided as follows along with embodiments and accompanying figures.

Figure 1:
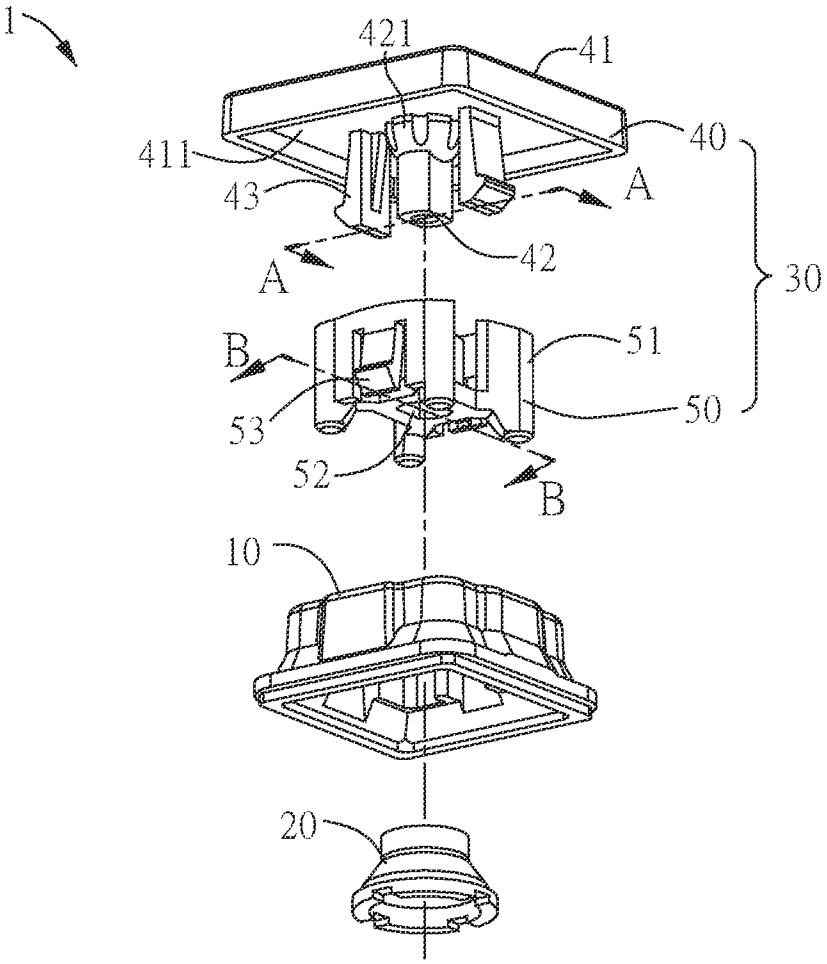
FIG. 1 is an exploded schematic diagram of a key structure of an embodiment of the present invention.
Figure 2:
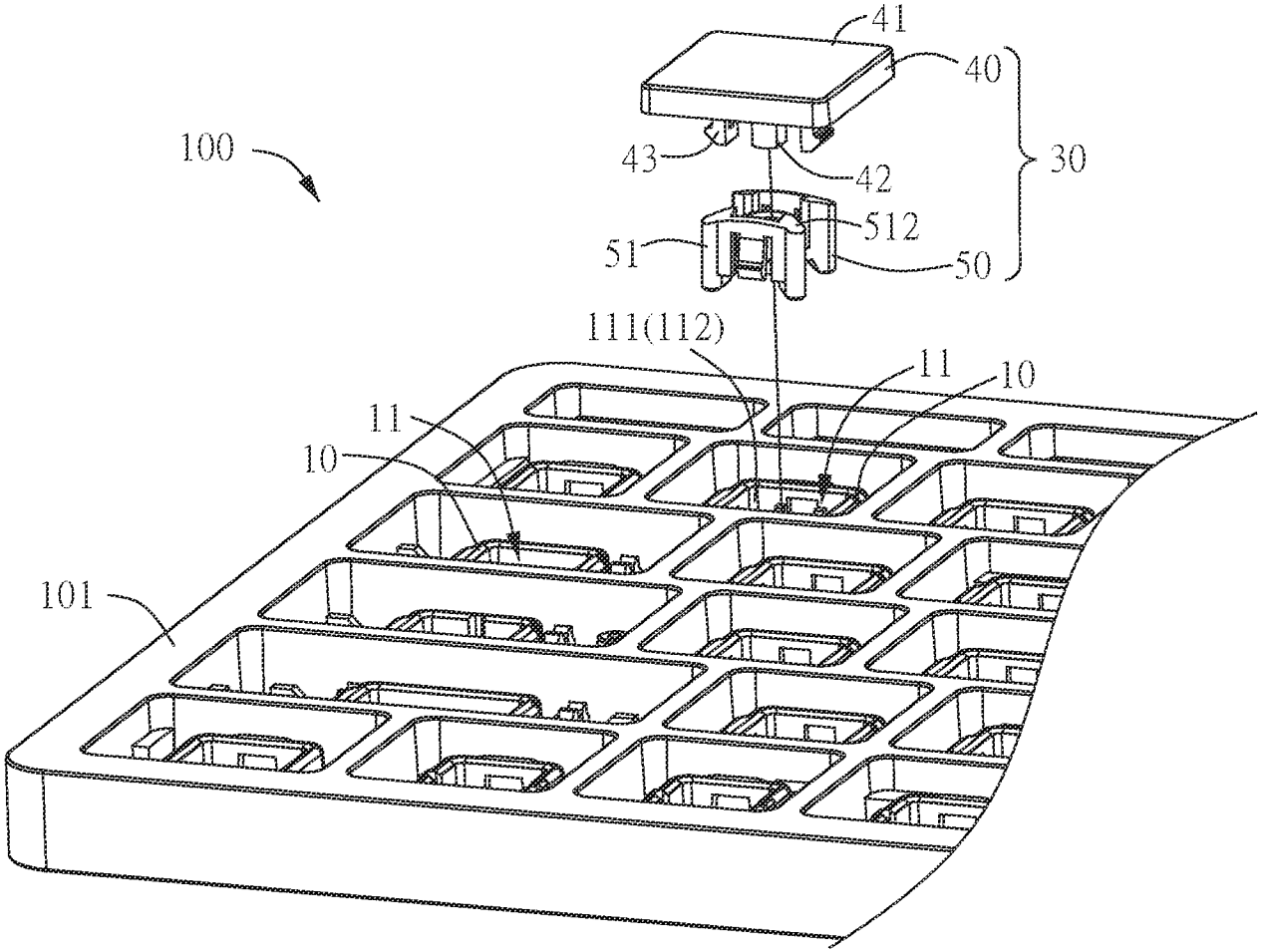
FIG. 2 is a schematic diagram of the key structure shown in FIG. 1 being used in a keyboard.
Figure 3:
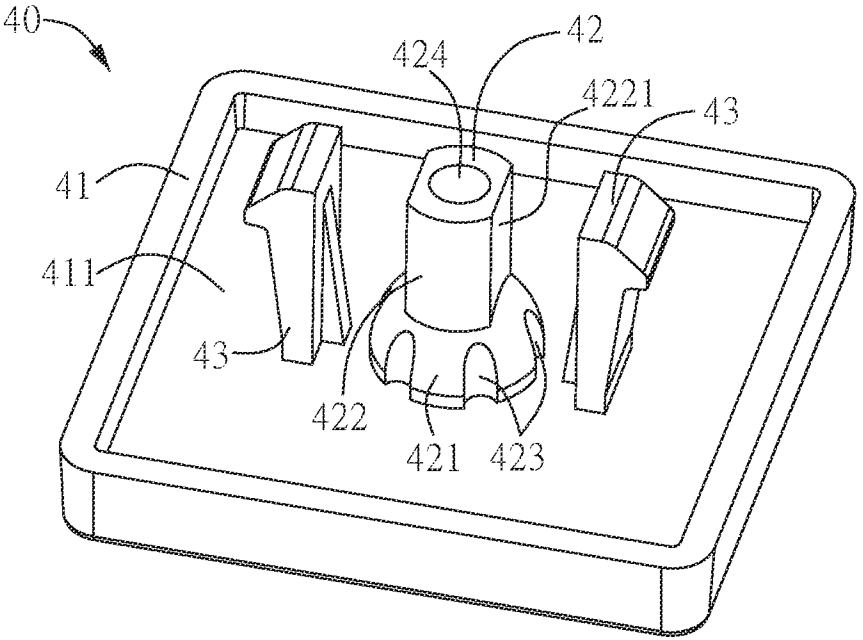
FIG. 3 is a schematic diagram of the keycap shown in FIG. 1.
Figure 4:
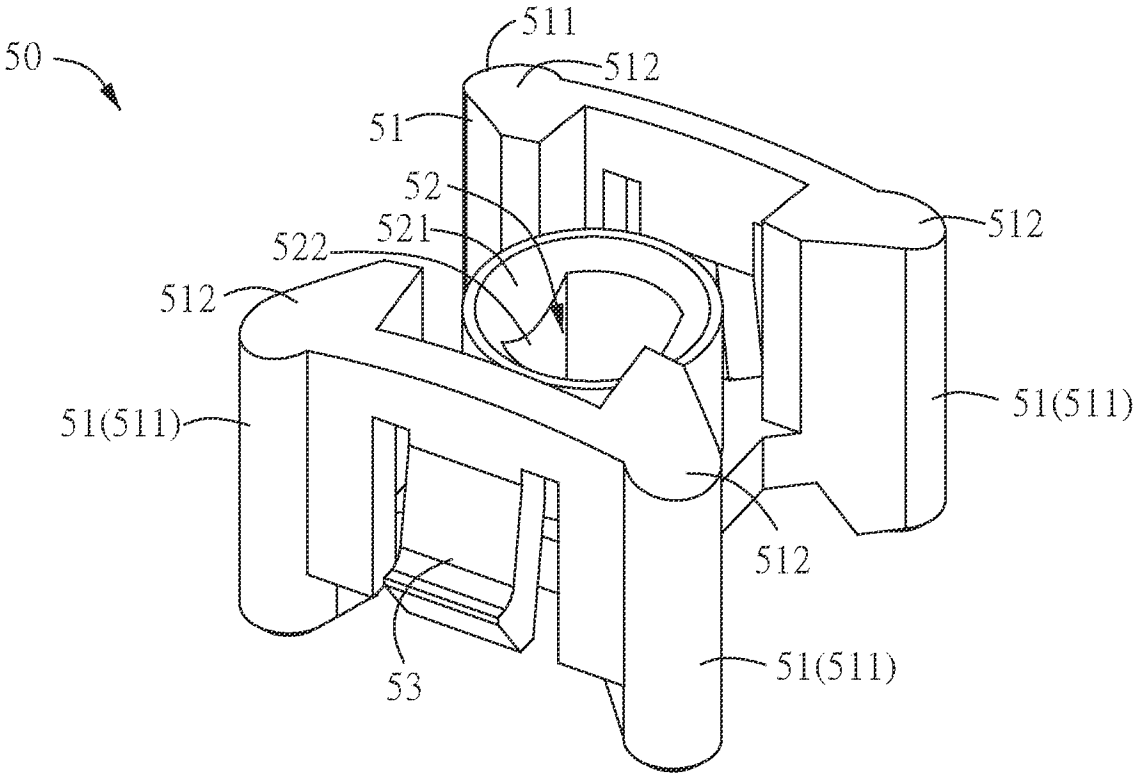
FIG. 4 is a schematic diagram of the holder shown in FIG. 1.
Figure 5:
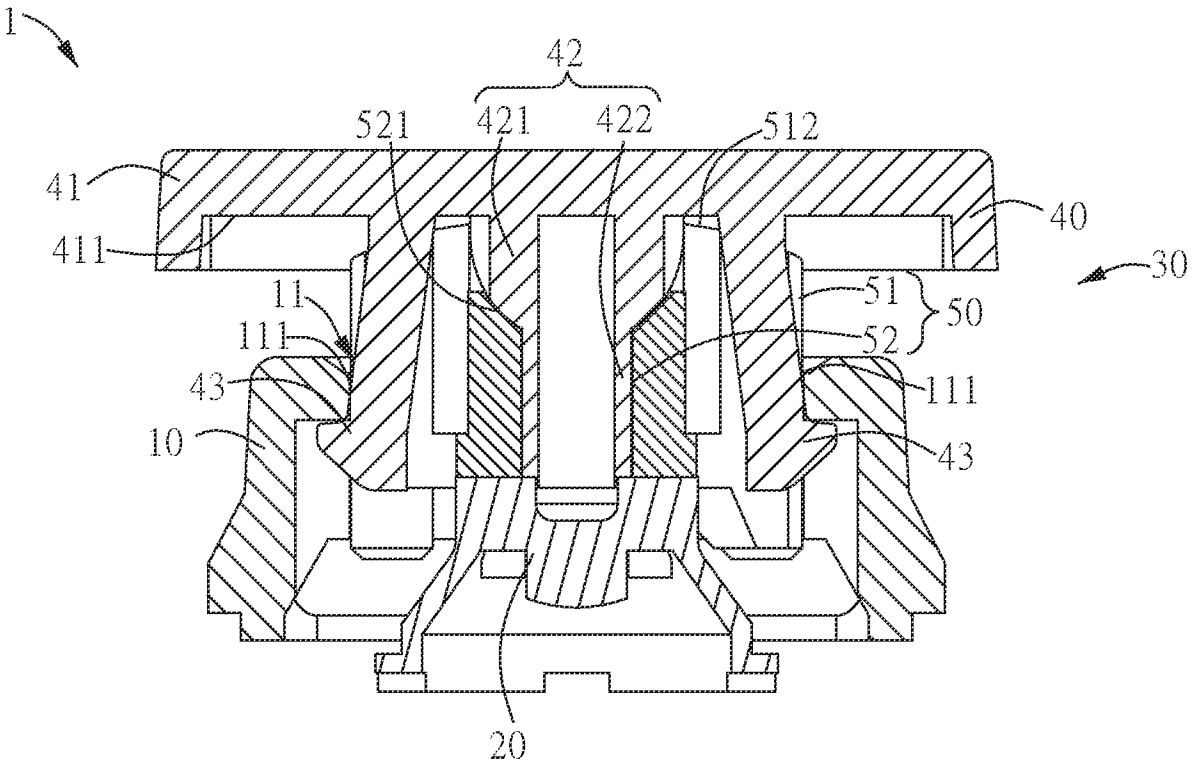
FIG. 5 is a sectional view of the key structure shown in FIG. 1 along the line A-A after assembly.
Figure 6:
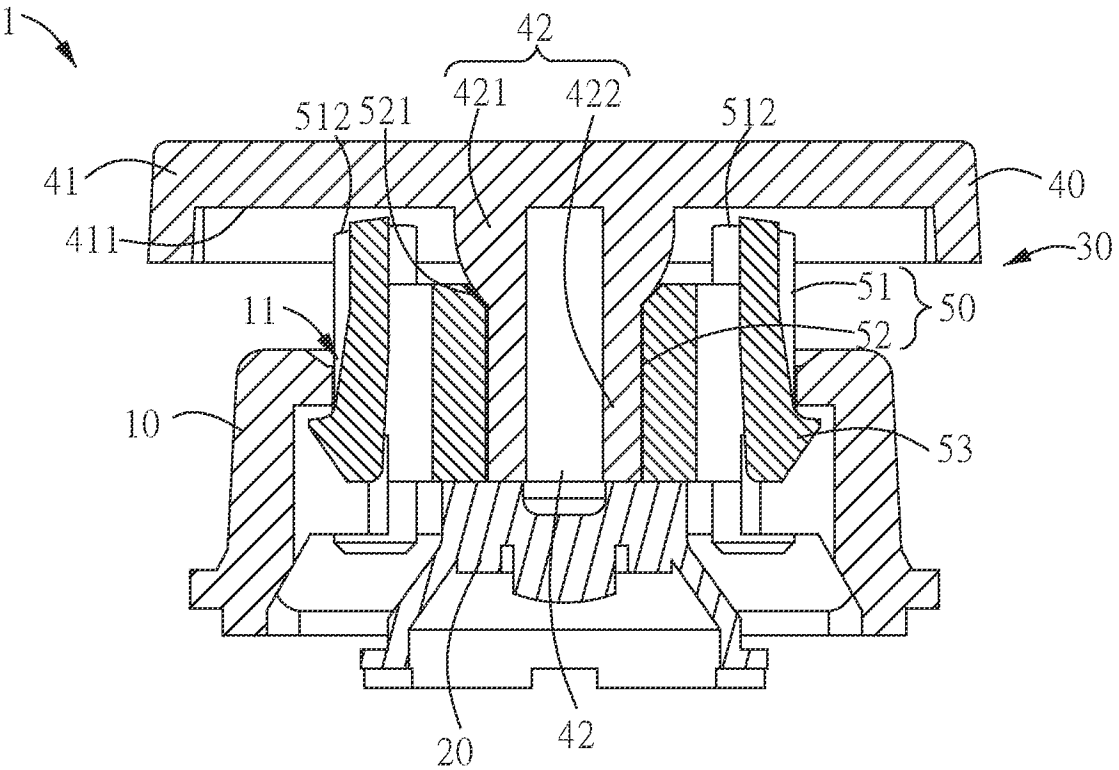
FIG. 6 is a sectional view of the key structure shown in FIG. 1 along the line B-B after assembly.

FIG. 1 is an exploded schematic diagram of a key structure of an embodiment of the present invention; FIG. 2 is a schematic diagram of the key structure shown in FIG. 1 being used in a keyboard; FIG. 3 is a schematic diagram of the keycap shown in FIG. 1; FIG. 4 is a schematic diagram of the holder shown in FIG. 1; FIG. 5 is a sectional view of the key structure shown in FIG. 1 along the line A-A after assembly; and FIG. 6 is a sectional view of the key structure shown in FIG. 1 along the line B-B after assembly. Please refer to the aforementioned figures for reference while reading the following description. In this embodiment, the key structure 1 comprises a casing 10, a restoring member 20 and a keycap assembly 30. As shown in FIG. 2, the casing 10 is hollow and has an opening 11 such that the restoring member 20 and parts of the keycap assembly 30 can be inserted into the casing 10 via the opening 11. It should be noted that the key structure 1 can be used in a keyboard 100 and that the casing 10 of the key structure 1 and a main body 101 of the keyboard 100 may be an integral structure or may be assembled from different members; the present invention is not limited to.

Please refer to FIG. 1, FIG. 5 and FIG. 6. The restoring member 20 is disposed in the casing 10 and corresponds to the opening 11 such that parts of the keycap assembly 30 are inserted into the casing 10 via the opening 11 and are able to contact the restoring member 20. The restoring member 20 may be, but is not limited to, a rubber dome, a metal spring, a spring sheet, a micro switch or a magnetic mechanism which can provide a restoring force to return the pressed keycap assembly 30 to the original position.

The keycap assembly 30 of the present invention comprises a keycap 40 and a holder 50. Please refer to FIG. 1 and FIG. 3. The keycap 40 comprises a pressing portion 41 and a central shaft 42. The pressing portion 41 has a bottom surface 411, and the central shaft 42 is connected to the bottom surface 411. In other words, the central shaft 42 extends from the bottom surface 411 in a direction away from the pressing portion 41.

In this embodiment, the central shaft 42 has a hemispherical portion 421, and the hemispherical portion 421 is adjacent to the bottom surface 411 of the pressing portion 41. In other words, the hemispherical portion 421 is formed at the connection between the central shaft 42 and the pressing portion 41. As shown FIG. 3, the hemispherical portion 421 is in the shape of a hemisphere. The circular plane of the hemisphere (i.e., the hemispherical portion 421) is connected to the bottom surface 411, and the convex surface faces away from the bottom surface 411. Furthermore, the central shaft 42 has a shaft portion 422, which is connected to the convex surface of the hemispherical portion 421 and extends from the hemispherical portion 421 in a direction away from the bottom surface 411. The keycap 40 of this embodiment is made by injection molding. Preferably, the hemispherical portion 421 and the shaft portion 422 are designed with a hollow structure, as shown in FIG. 3, to prevent the hemispherical portion 421 and the shaft portion 422 from shrinking during formation. For example, a plurality of concave recesses 423 are disposed at the connection between the hemispherical portion 421 and the bottom surface 411 in intervals, and the center of the shaft portion 422 is a hollow structure 424, but the present invention is not limited thereto.

As shown in FIG. 3 and FIG. 5, the keycap 40 further comprises at least one first snap 43, and it should be noted that this embodiment employs two first snaps 43 as an example. Both the central shaft 42 and the first snap 43 are connected to the bottom surface 411, and both the central shaft 42 and the first snap 43 extend from the bottom surface 411 in a direction way from the pressing portion 41. One end of the first snap 43 is connected to the bottom surface 411, the other end of which is a hook structure. During the assembly process, the holder 50 is inserted into the casing 10 via the opening 11 first, and the holder 50 contacts the restoring member 20. Then the first snap 43 of the keycap 40 corresponds to the opening 11, and the person or the machine performing the assembly process applies force to the keycap 40 to place the first snap 43 into the casing 10 via the opening 11. When the force is no longer applied, the restoring member 20 provides the restoring force to return the keycap 40 and the holder 50 to the original position such that the first snap 43 snaps onto the casing 10. Specifically, the first snap 43 hooks an inner edge of the opening 11 so as to snap onto the casing 10.

Please refer to FIG. 1, FIG. 2 and FIG. 4. The holder 50 comprises at least one guiding post 51 and a shaft bore 52. The guiding post 51 can guide the holder 50 as the holder 50 moves into the casing 10 and is displaced within the casing 10. Specifically, the guiding post 51 corresponds to an inner wall 111 of the opening 11, and the guiding post 51 contacts the inner wall 111 such that the inner wall 111 guides the holder 50 into the casing 10. In this embodiment, the opening 11 of the casing 10 is quadrilateral. Correspondingly, the holder 50 may have four guiding posts 51. One of the guiding posts 51 corresponds to one corner 112 of the opening 11 (as shown in FIG. 2) such that the guiding post 51 is able to guide the holder 50 as the holder 50 moves into the casing 10 along the corner 112.

As shown in FIG. 4, preferably, the guiding post 51 has a curved side surface 511, and the curved side surface 511 is in linear contact with the opening 11. In other words, the area where the curved side surface 511 contacts the inner wall 111 is linear in shape to minimize the contact area between the curved side surface 511 and the inner wall 111. When the keycap 40 is pressed and moves downward, the inner wall 111 may be prevented from generating excessive friction on the guiding post 51 by the aforementioned structure. In other words, the linear contact design of the curved side surface 511 and the inner wall 111 can achieve the effect of labor-saving.

Moreover, the shaft bore 52 is located at the central area of the holder 50 to accommodate the central shaft 42 of the keycap 40. The shaft bore 52 has arcuate socket 521 to accommodate the hemispherical portion 421 of the central shaft 42. The hemispherical portion 421 and the arcuate socket 521 are matched with each other. Specifically, the hemispherical portion 421 of this embodiment is a hemisphere, and the arcuate socket 521 is a semicircular groove correspondingly. When the shaft portion 422 of the central shaft 42 passes through the shaft bore 52, the convex surface of the hemispherical portion 421 is accommodated in the arcuate socket 521. When the pressing portion 41 is pressed and inclined, the hemispherical portion 4211 can be displaced in the arcuate socket 521, which is similar to the structure of a universal joint.

Specifically, during the assembly process, the holder 50 is inserted into the casing 10 first, and then the central shaft 42 of the keycap 40 is aligned with the shaft bore 52 to cause the central shaft 42 to pass through the shaft bore 52. As shown in FIG. 5 and FIG. 6, the shaft portion 422 of the central shaft 42 passes through the shaft bore 52 and contacts the restoring member 20, and the hemispherical portion 421 is accommodated in the arcuate socket 521.

In addition, please refer to FIG. 5. A top surface 521 of the guiding post 51 does not contact the bottom surface 411 of the pressing portion 41. Specifically, in this embodiment, the top surface 512 of the guiding post 51 is an oblique plane extending outward and toward the casing 10. In other words, the top surface 512 is an oblique plane extending downward and toward the outside of the holder 50. Therefore, when the central shaft 42 of the keycap 40 is inserted into the shaft bore 52, the central shaft 42 and its hemispherical portion 421 are supported by the arcuate socket 521, and the guiding post 51 does not contact the pressing portion 41.

When the pressing portion 41 is pressed, especially when an edge or a corner of the pressing portion 41 is pressed, the entire pressing portion 41 will tilt or shift such that the central shaft 42 will shift with the pressing portion 41. Because the structure of the hemispherical portion 421 and the arcuate socket 521 are matched with each other, the hemispherical portion 421 can be displaced in the arcuate socket 521 (which is similar to a universal joint) such that the movable space of the keycap 40 can be increased. Further, because the guiding post 51 does not contact the pressing portion 41, the pressing portion 41 has more space to shift or tilt without being restricted by the guiding post 51. Therefore, the keycap assembly 30 is a two-piece structure (i.e., comprising the keycap 40 and the holder 50), the hemispherical portion 421 and the arcuate socket 521 are matched with each other, and the guiding post 51 does not contact the pressing portion 41. These structures can increase the movable space of the keycap 40 so as to achieve the effect of preventing the keycap 40 from becoming stuck.

Figure 7:
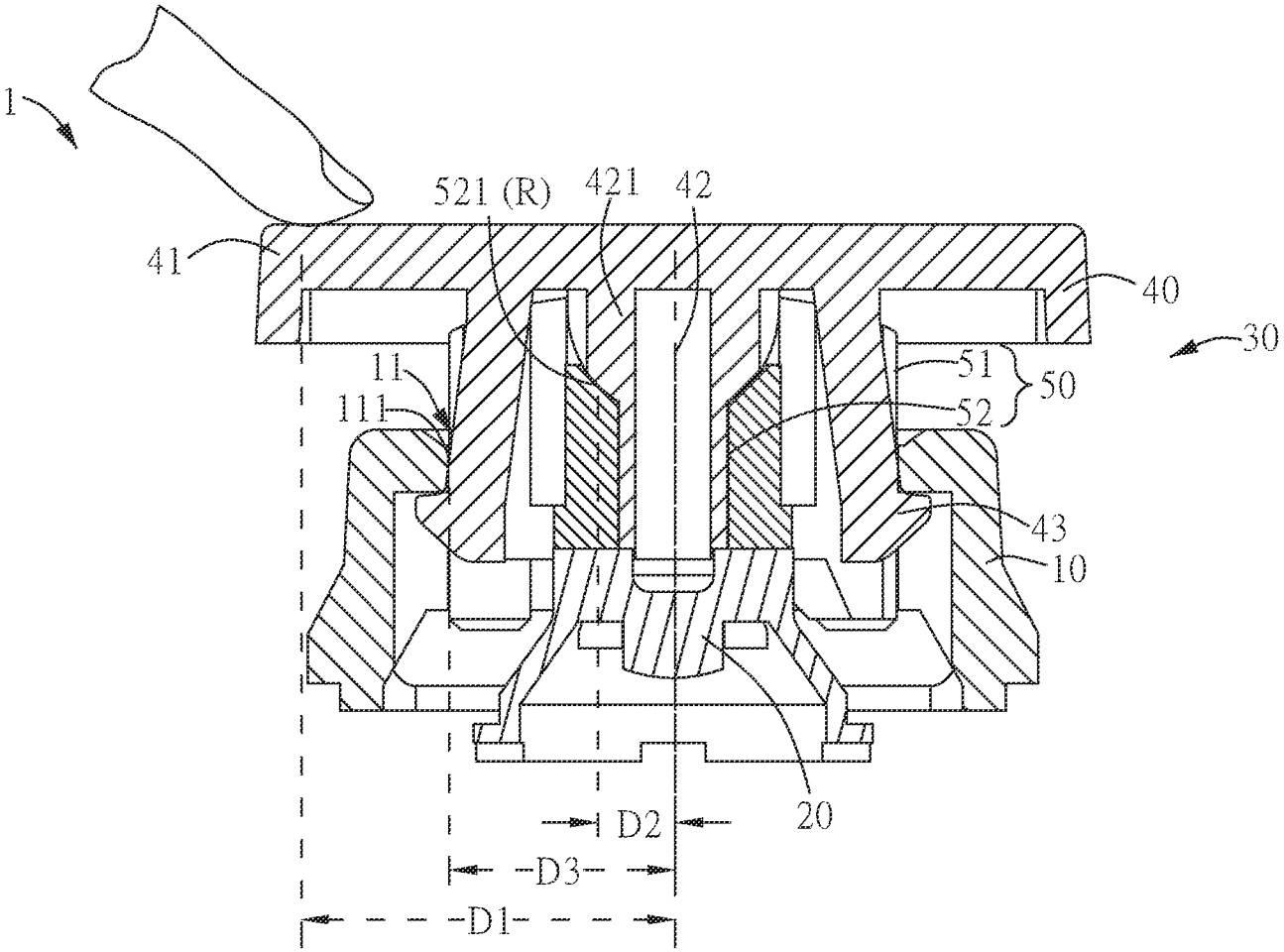
FIG. 7 is a schematic diagram of the key structure shown in FIG. 5 to illustrate a point of resisting force.

FIG. 7 is a schematic diagram of the key structure shown in FIG. 5 and is presented to illustrate a point of resisting force. Please refer to FIG. 7. When the edge or the corner of the pressing portion 41 is pressed, the point of application is located at the pressing position, the fulcrum is located at the center of the central shaft 42, and an effort arm D1 is the distance between the point of application and the fulcrum. Due to the hemispherical portion 421 and the arcuate socket 521 contacting each other while the edge or the corner of the pressing portion 41 is pressed, a contact point between the hemispherical portion 421 and the arcuate socket 521 may form a point R of resisting force. A resistance arm D2 is the distance between the point R of resisting force and the fulcrum.

In the conventional key structure, the keycap assembly 30 is a single member the keycap 40 and the holder 50 are combined). In other words, the conventional keycap includes the guiding posts. Therefore, when the edge or corner of the conventional keycap is pressed, the point of resisting force is located at a contact point between the guiding post and the opening of the casing. In the conventional keycap, a resistance arm D3 is the distance between the point of resisting force (i.e., the contact point between the guiding post and the opening) and the fulcrum (i.e., the center of the central shaft). It should be noted that, for the sake of easy understanding, the resistance arm D3 generated by pressing the conventional keycap is marked in FIG. 7. This paragraph describes the conventional keycap, so it does not use the reference numerals.

As shown in FIG. 7, the resistance arm D2 generated by pressing the keycap assembly 30 of this embodiment is less than the resistance arm D3 generated by pressing the conventional keycap. The resistance arm D2 is less than the resistance arm D3 and thus can achieve the effect of saving labor. Therefore, the keycap assembly 30 of this embodiment can achieve a more labor-saving effect as compared with the conventional keycap with a single member.

In addition to achieving the labor-saving effect, in this embodiment, the keycap 40 and the holder 50 may be made of different materials to achieve an effect of changing the appearance of the key structure 1 at low cost. For example, the holder 50 may be made of a plastic material such as polyoxymethylene (POM), which has the characteristics of a low friction coefficient and great rigidity. The keycap 40 may be of plastic, ceramic, wood, or other materials according to the desired appearance.

Please refer to FIG. 3 and FIG. 4. Preferably, in this embodiment, both the shaft portion 422 of the central shaft 42 and the shaft bore 52 are non-circular in structure. The non-circular structure is able to prevent the shaft portion 422 from rotating in the shaft bore 52 so as to prevent shaking of the entire keycap 40. Specifically, the shaft portion 422 has a first plane 4221 on its two sides, and the shaft bore 52 of the holder 50 has a second plane 522. The first plane 4221 corresponds to the second plane 522 while the keycap 40 is assembled with the holder 50 so as to restrict the rotation of the shaft portion 422 in the shaft bore 52.

It should be noted that the assembly sequence of the key structure 1 of this embodiment is such that, after the holder 50 is inserted into the casing 10, the keycap 40 is assembled with the holder 50; that is, the central shaft 42 of the keycap 40 is inserted into the shaft bore 52 of the holder 50. As described above, after the keycap 40 is assembled with the casing 10, the first snap 43 may snap onto the casing 10. At this time, the keycap 40 is able to limit the position of the holder 50 located below it to prevent the holder 50 from falling out of the opening 11 and to fix the holder 50 in the casing 10.

As shown in FIG. 4 and FIG. 6, in order to facilitate an automated assembly procedure, preferably, the holder 50 further comprises at least one second snap 53. Specifically, when the holder 50 is inserted into the casing 10, the second snap 53 is inserted into the casing 10 via the opening 11 together with the holder 50. Because the holder 50 contacts the restoring member 20, the restoring member 20 can provide an elastic force to return the holder 50 to its original position such that the second snap 53 snaps onto the casing 10, as shown in FIG. 6. At this time, even if the keycap 40 is not assembled with the holder 50, the holder 50 is still fixed in the casing 10 by the second snap 53 to prevent the holder 50 from falling out of the opening 11. Therefore, after the holder 50 is inserted into the casing 10, the main body 101 of the keyboard 100 (as shown FIG. 2) can be transferred to the working area where the keycap 40 is added to the assembly, and there is no need to worry about the holder 50 becoming dislodged during the transfer.

As mentioned above, according to a key structure and a keycap assembly of the present invention, the keycap assembly comprises a keycap and a holder. A central shaft of the keycap has a hemispherical portion, and a shaft bore of the holder has an arcuate socket corresponding to the hemispherical portion. After the central shaft passes through the shaft bore, the hemispherical portion is accommodated in the arcuate socket. Because of the matched structure of the hemispherical portion and the arcuate socket, the hemispherical portion can be displaced in the arcuate socket to increase the movable space of the keycap. In brief, because the keycap assembly is a two-piece structure (i.e., comprising the keycap and the holder) and because the hemispherical portion and the arcuate socket are matched with each other, the space for displacement of the keycap can be increased such that the keycap can be prevented from becoming stuck.

In addition, the holder has a guiding post designed such that the guiding post does not contact the pressing portion, and the pressing portion has space for shifting or tilting without being restricted by the guiding post so as to achieve the aforementioned effect of preventing the keycap from becoming stuck.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the appended claims.

What is claimed is:

1. A key structure, comprising:
- a casing, having an opening;
- a restoring member disposed in the casing; and
- a keycap assembly, comprising:
  - a keycap comprising a pressing portion and a central shaft, the pressing portion having a bottom surface, the central shaft connected to the bottom surface, the central shaft having a hemispherical portion adjacent to the bottom surface; and
  - a holder inserted into the casing via the opening and contacting the restoring member, the holder comprising a shaft bore having an arcuate socket, wherein the central shaft passes through the shaft bore and contacts the restoring member, and the hemispherical portion is accommodated in the arcuate socket.

2. The key structure of claim 1, wherein when the pressing portion is pressed, the hemispherical portion is displaced in the arcuate socket.

3. The key structure of claim 1, wherein when an edge of the pressing portion is pressed, a contact point between the hemispherical portion and the arcuate socket forms a point of resisting force.

4. The key structure of claim 1, wherein the central shaft further comprises a shaft portion, and the shaft portion extends from the hemispherical portion in a direction away from the bottom surface.

5. The key structure of claim 4, wherein both the shaft portion and the shaft bore are non-circular in structure.

6. The key structure of claim 5, wherein the shaft portion has a first plane, the shaft bore of the holder has a second plane, and the first plane corresponds to the second plane to restrict the shaft portion from rotating in the shaft bore.

7. The key structure of claim 1, wherein the holder further comprises a guiding post contacting an inner wall of the opening, and a top surface of the guiding post does not contact the pressing portion.

8. The key structure of claim 7, wherein the guiding post corresponds to one corner of the opening, and the holder is guided into the casing by the guiding post.

9. The key structure of claim 1, wherein the keycap comprises at least one first snap connecting to the bottom surface, and the first snap is inserted into the casing via the opening and snaps onto the casing.

10. The key structure of claim 1, wherein the holder further comprises a second snap, and the second snap is inserted into the casing via the opening and snaps onto the casing.

11. A keycap assembly, used in a key structure, comprising a casing having an opening and a restoring member disposed in the casing, the keycap assembly comprising:
- a keycap, comprising:
  - a pressing portion having a bottom surface; and
  - a central shaft connected to the bottom surface, the central shaft having a hemispherical portion adjacent to the bottom surface; and
- a holder inserted into the casing via the opening and contacting the restoring member, the holder comprising:
  - a shaft bore having an arcuate socket, wherein the central shaft passes through the shaft bore and contacts the restoring member, and the hemispherical portion is accommodated in the arcuate socket.

12. The keycap assembly of claim 11, wherein when the pressing portion is pressed, the hemispherical portion is displaced in the arcuate socket.

13. The keycap assembly of claim 11, wherein when an edge of the pressing portion is pressed, a contact point between the hemispherical portion and the arcuate socket forms a point of resisting force.

14. The keycap assembly of claim 11, wherein the central shaft further comprises a shaft portion, and the shaft portion extends from the hemispherical portion in a direction away from the bottom surface.

15. The keycap assembly of claim 14, wherein both the shaft portion and the shaft bore are non-circular in structure.

16. The keycap assembly of claim 15, wherein the shaft portion has a first plane, the shaft bore of the holder has a second plane, and the first plane corresponds to the second plane to restrict the shaft portion from rotating in the shaft bore.

17. The keycap assembly of claim 11, wherein the holder further comprises a guiding post contacting an inner wall of the opening, and a top surface of the guiding post does not contact the pressing portion.

18. The keycap assembly of claim 17, wherein the guiding post corresponds to one corner of the opening, and the holder is guided into the casing by the guiding post.

19. The keycap assembly of claim 11, wherein the keycap comprises at least one first snap connecting to the bottom surface, and the first snap is inserted into the casing via the opening and snaps onto the casing.

20. The keycap assembly of claim 11, wherein the holder further comprises a second snap, and the second snap is inserted into the casing via the opening and snaps onto the casing.

* * * * *